US008204393B2

(12) United States Patent
Winter et al.

(10) Patent No.: US 8,204,393 B2
(45) Date of Patent: Jun. 19, 2012

(54) METHOD FOR PREVENTING THE INFLUENCE OF THE TRANSFER OF VIBRATIONS DURING THE PRINTING OF IMAGES ON A FINAL IMAGE CARRIER

(75) Inventors: Hans Winter, München (DE); Frank Freudenberg, Rattenkirchen (DE); Stefan Scherdel, Markt Schwaben (DE)

(73) Assignee: Oce Printing Systems GmbH, Poing (DE)

( * ) Notice: Subject to any disclaimer, the term of this patent is extended or adjusted under 35 U.S.C. 154(b) by 572 days.

(21) Appl. No.: 12/299,857

(22) PCT Filed: Apr. 3, 2007

(86) PCT No.: PCT/EP2007/053242

§ 371 (c)(1),
(2), (4) Date: Jul. 21, 2009

(87) PCT Pub. No.: WO2007/137898

PCT Pub. Date: Dec. 6, 2007

(65) Prior Publication Data

US 2009/0310988 A1 Dec. 17, 2009

(30) Foreign Application Priority Data

May 31, 2006 (DE) ..... 10 2006 025 400

(51) Int. Cl.
*G03G 15/01* (2006.01)

(52) U.S. Cl. ..... 399/39; 399/302

(58) Field of Classification Search ..... 399/298, 399/302, 306, 388, 397, 39, 40
See application file for complete search history.

(56) References Cited

U.S. PATENT DOCUMENTS

| | | | | |
|---|---|---|---|---|
| 6,246,856 | B1 * | 6/2001 | Kopp et al. | 399/302 |
| 2007/0189806 | A1 | 8/2007 | Lobel | |

FOREIGN PATENT DOCUMENTS

| | | | |
|---|---|---|---|
| DE | 103 45 149 | A1 | 4/2005 |
| EP | 1 202 125 | A2 | 5/2002 |
| EP | 1 562 084 | A2 | 8/2005 |
| JP | 2001312154 | A | 11/2001 |
| WO | WO 98/39691 | | 9/1998 |

* cited by examiner

*Primary Examiner* — William J Royer
(74) *Attorney, Agent, or Firm* — Schiff Hardin LLP

(57) ABSTRACT

In a method for electrographic printing of color images on a final image carrier, charge images of images to be printed are generated on a charge image carrier and are developed into toner images with toner, the toner images being transferred onto an intermediate carrier from which they are transfer-printed onto the final image carrier. The charge images for individual colors of the color image are generated in succession on the charge image carrier and are developed into individual color toner images with color toner. The individual color toner images are transferred onto the intermediate carrier and are there collected atop of one another in a color collection cycle to form a complete color toner image. Before transfer printing of the complete color toner image on the final image carrier, the final image carrier is pivoted onto the intermediate carrier, and after the transfer printing, the final image carrier is pivoted away from the intermediate carrier. After transfer printing of the complete color toner image, the color toner images for a next complete color image are transferred from the charge image carrier onto the intermediate carrier after an end of the pivoting of the final image carrier away from the intermediate carrier.

6 Claims, 6 Drawing Sheets

METHOD FOR PREVENTING THE INFLUENCE OF THE TRANSFER OF VIBRATIONS DURING THE PRINTING OF IMAGES ON A FINAL IMAGE CARRIER

BACKGROUND

A printer or copier according to the electrophotographic principle with which color printing can be conducted is described in WO 98/39691; the content of WO 98/39691 is herewith incorporated into the disclosure of this specification. In FIG. 1, a principle image of a printer DR according to WO 98/39691 is presented that is drawn upon to explain the preferred embodiment. Character generators ZG (for example on both sides of a final image carrier AT, for example a paper web) generate on a charge image carrier OPC (for example a photoconductor belt) charge images of the images to be printed. These are inked with toner into toner images in a developer station ES. The toner images are subsequently transferred in succession to an intermediate carrier TFB (for example a transfer belt)—in the following this transfer location is called a transfer printing station U1—and are collected there into a complete toner image. This is transfer-printed onto the final image carrier AT (in the following this transfer location is called a transfer printing station U2) and is subsequently fixed there. The printing according to WO 98/39691 and FIG. 1 can occur on both sides of the final image carrier AT. Refer to WO 98/39691 for details.

Upon generation of a multicolor image, the printer DR transitions into a start/stop operation. While the final image carrier AT stands still, the colors are collected on the intermediate carrier TFB (the transfer belt) into a complete color toner image (one collection cycle length thereby corresponds to the number of the color*transfer belt length). The final image carrier AT is then started so that the complete color toner image on the intermediate carrier TFB is transfer-printed precisely, line-by-line, onto the preceding print image on the final image carrier AT at the transfer printing station U2.

The chronological path of the creation of a print image, from the generation of the charge image on the oscillating circuit (in the following a photoconductor belt OPC) up to the transfer-printing onto the final image carrier AT is shown using FIG. 2; it is thereby assumed that the print image is composed of two colors F1 and F2. The charge image is respectively generated by a character generator ZG from the two colors F1 and F2 in succession on the photoconductor belt OPC (line Z1). The position of the toned charge image of the two colors F1 and F2 at the transfer printing station U1 is shown in line Z2 relative to the intermediate carrier (in the following a transfer belt TFB). Line Z3 shows the generation of the complete color toner image on the transfer belt TFB at the transfer printing station U2, and the position of the complete color toner image B transfer-printed onto the final image carrier AT results from line Z4. It is to be recognized that the complete color toner image B is generated on the transfer belt TFB (line Z3) from the successive colors Fl and F2 transferred onto the transfer belt TFB, and then the complete color toner image B is transfer-printed onto the final image carrier AT. The complete color toner image is then fixed on the final image carrier AT in a known manner (can be learned from WO 98/39691). For transfer-printing of the complete color toner image B from the transfer belt TFB onto the final image carrier AT, this is started, accelerated to printing speed and then pivoted onto the transfer belt TFB (region A1 in line Z4); after the transfer printing the final image carrier AT is pivoted away from the transfer belt TFB (region A2 in line Z4) and stopped again. Due to the pivoting motion (regions A1 and A2) of the final image carrier AT onto or away from the transfer belt TFB, vibrations are generated therein that can affect the photoconductor belt OPC via the transfer belt TFB and can lead to the situation that the toner images of the two colors Fl and F2 shift somewhat, with the result that the colors Fl and F2 no longer exactly overlap on the transfer belt TFB. This situation is represented in FIG. 2 by the dashed lines L1 and L2 running vertically. It is to be recognized that the dashed lines L1, L2, and therefore the vibrations, affect the photoconductor belt OPC, and in fact the character generator ZG and the transfer printing station U1.

A method with which both color images and monochrome images can be generated with an electrophotographic printer is known from EP 1 562 084 A2. For this, charge images of the images are generated on a charge image carrier, these are inked with toner, the toner images are transfer-printed onto a transfer belt in a first transfer printing process and from there onto a recording medium (for example a paper sheet). For this purpose, the recording medium is pivoted onto the transfer belt. Via the pivoting of the recording medium onto the transfer belt, vibrations are generated therein and the charge image carrier that lead to unwanted displacements of the toner images on the transfer belt. This is in particular disadvantageous in color printing since then the individual color toner images of a color image that are collected on the transfer belt no longer come to lie exactly atop one another. In order to avoid this disadvantage given color images generated from four color toners, it is proposed to use color toner of a yellow color as a last color in the color collection cycle since the human eye registers the shift of the yellow color toner image least in comparison to the other color toner images.

DE 103 45 149 A1 deals with a problem that arises in that a second belt is pivoted onto or away from a revolving first belt. A slack at the drive roller for the first belt is generated by the load, with the consequence that the revolution speed of the first belt changes. This is disadvantageous when the belt is a transfer belt in an electrographic printer. Solutions of how the slack can be avoided are now proposed.

SUMMARY

It is an object to specify a method in which the vibrations generated by the pivoting of a final image carrier onto or away from the intermediate carrier (for example a transfer belt) have no disruptive influence on the generation of the charge images on the charge image carrier (for example a photoconductor belt) or have no disruptive influence on the transfer of the developed charge images onto the intermediate carrier.

In a method for electrographic printing of color images on a final image carrier, charge images of the images to be printed are generated on a charge image carrier and are developed into toner images with toner, the toner images being transferred onto an intermediate carrier from which they are transfer-printed onto the final image carrier. The charge images for the individual colors of the color image are generated in succession on the charge image carrier and are developed into individual color toner images with color toner. The individual color toner images are transferred onto the transfer belt and are there collected atop of one another in a color collection cycle to form a complete color toner image. Before the transfer printing of the complete color toner image on the final image carrier, the final image carrier is pivoted onto the transfer belt, and after the transfer printing, the final image carrier is pivoted away from the transfer belt. After transfer printing of the complete color toner image, the color toner images for the next complete color image are transferred from the charge image carrier onto the transfer belt after an end of the pivoting of the final image carrier away from the transfer belt.

DESCRIPTION OF THE PREFERRED EMBODIMENTS

Figure 1:
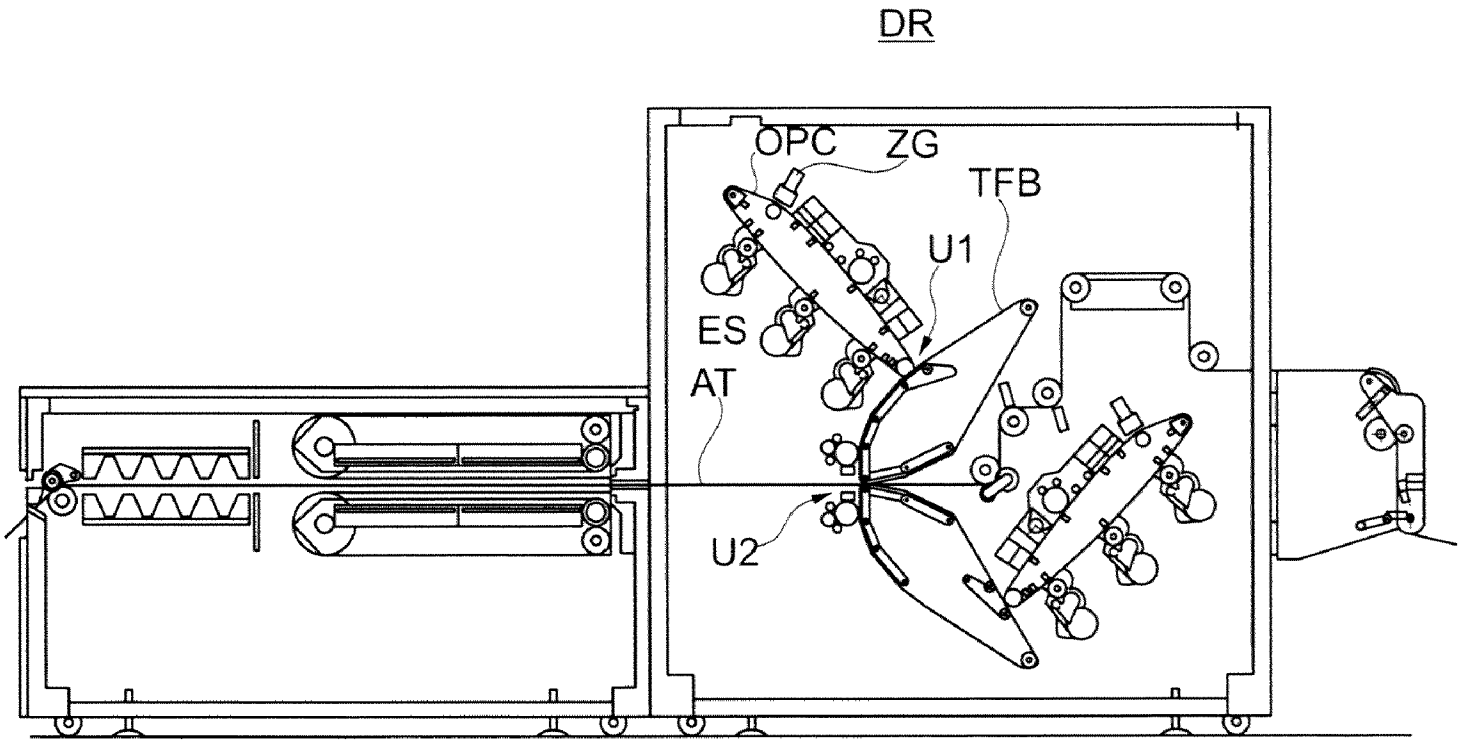
Prior Art Fig. 1
FIG. 1 illustrates a printer and with the methods of the preferred embodiments are performed.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The disruptions at the final image carrier are avoided when the point in time of the generation of the charge images on the charge image carrier and/or the transfer of the toner images onto the intermediate carrier is set so that the vibrations caused by the pivoting of the final image carrier onto or away from the intermediate carrier and the charge image carrier can have no influence on the generation of the charge images on the charge image carrier and/or the transfer of the toner images on the oscillating circuit.

In a first solution, the charge images for the next image to be printed are only generated on the charge image carrier when the vibrations generated by the pivoting process of the final image carrier have died away.

In a second solution, no toner images are transferred onto the intermediate carrier at the time of the disruptions caused by the pivot process of the final image carrier.

The two solutions can additionally be combined.

In electrographic printing using a photoconductor belt as a charge image carrier and a transfer belt as an intermediate carrier, the charge images are generated on the photoconductor belt by a character generator and are then developed into toner images that are transferred onto the transfer belt and from there are transfer-printed onto the final image carrier. During the transfer printing of the toner images from the transfer belt onto the final image carrier, this is pivoted onto the transfer belt; otherwise it is pivoted away. The generation of the charge images on the photoconductor belt or the transfer of the toner images onto the transfer belt only occurs when the vibrations generated in the transfer belt by the pivoting of the final image carrier onto or away from the transfer belt have died away.

In color printing, the charge images for the individual colors of the color image are generated in succession on the photoconductor belt and are developed with color toner into individual color toner images; the individual color toner images are transferred onto the transfer belt and there are collected atop one another to form a complete color toner image, such that the transfer belt is moved further along a revolution after the acceptance of each color toner image. During the transfer printing of the color toner image onto the final image carrier, this is pivoted onto the transfer belt; otherwise this is pivoted away from the transfer belt. The generation of the charge images on the photoconductor belt or the transfer of the color toner images from the photoconductor belt onto the transfer belt is set so that these procedures do not occur during the pivoting of the final image carrier onto or away from the transfer belt.

In a first solution, the generation of the charge images for the next complete color toner image on the photoconductor belt can have occurred only when the final image carrier has been pivoted onto or away from the transfer belt after the transfer printing of the preceding complete color toner image.

In a second solution, the transfer of the complete color toner image is only implemented when the complete color toner image collected on the transfer belt has been moved into a second or nth (n is an integer) revolution at the transfer printing station in order to be transfer-printed. The transfer of the color toner images of the next complete color toner image onto the transfer belt can then occur after the end of the transfer printing of the preceding complete color toner image or the beginning of the generation of the charge images for the next complete color toner image can be started after the end of the transfer printing of the preceding complete color toner image.

Figure 2:
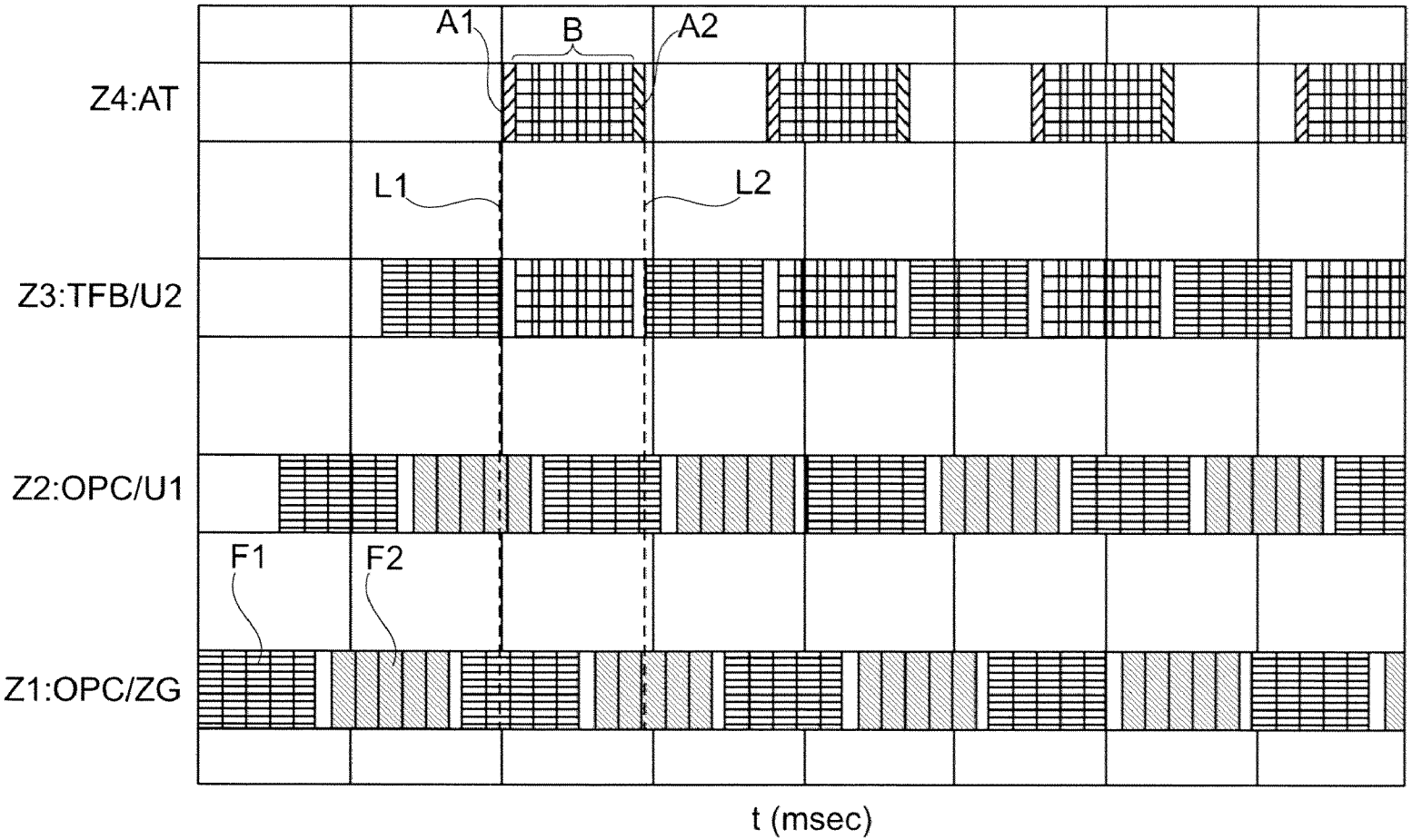
Prior Art Fig. 2
FIG. 2 shows the chronological position of the print image without compensation for a disruption.

In FIGS. 3 through 6, lines Z are labeled corresponding to FIG. 2. The workflow of the method is thereby shown plotted in msec over time t.

Figure 3:
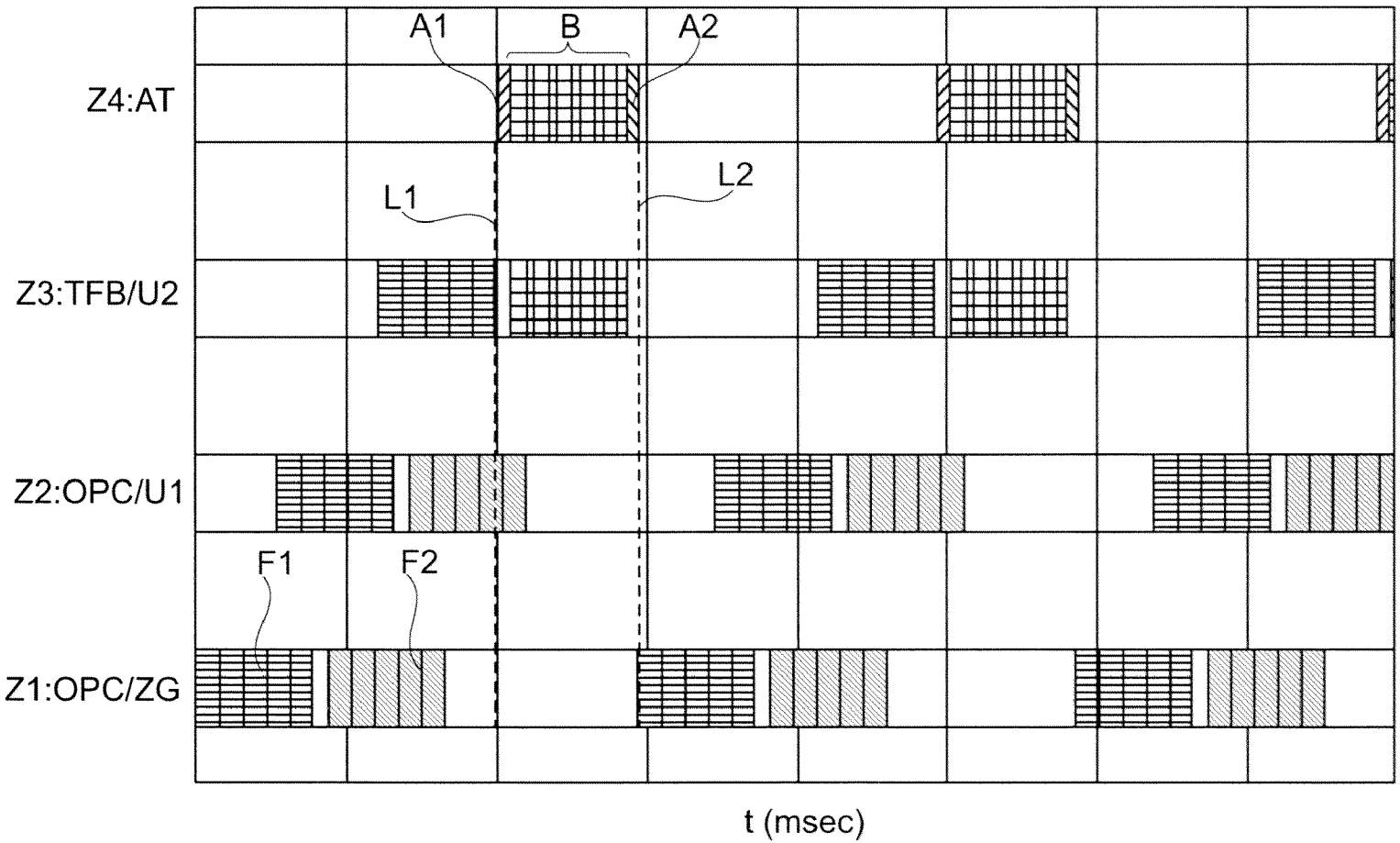
FIG. 3 shows the chronological position of the print image with compensation of the disruption in longer pauses between the color collection cycles on the transfer belt.

In the solution of FIG. 3, the influence of the disruptions on the photoconductor belt OPC due to the pivoting of the final image carrier AT onto or away from the transfer belt TFB is avoided in that longer pauses are inserted between the color collection cycles. The transfer printing of the complete color toner image B onto the final image carrier AT occurs before the next color collection cycle has started on the photoconductor belt OPC. Therefore no disruption occurs at the transfer printing station U1 upon pivoting the final image carrier AT away from the transfer belt TFB. Furthermore, with an even larger delay it can be achieved that, in addition to no disruption at the transfer printing at the transfer printing station U1, no disruption also occurs at the character generator by ZG during the generation of charge images. The dashed lines L1, L2 have been drawn again in FIG. 3 to represent these solutions.

Figure 4:
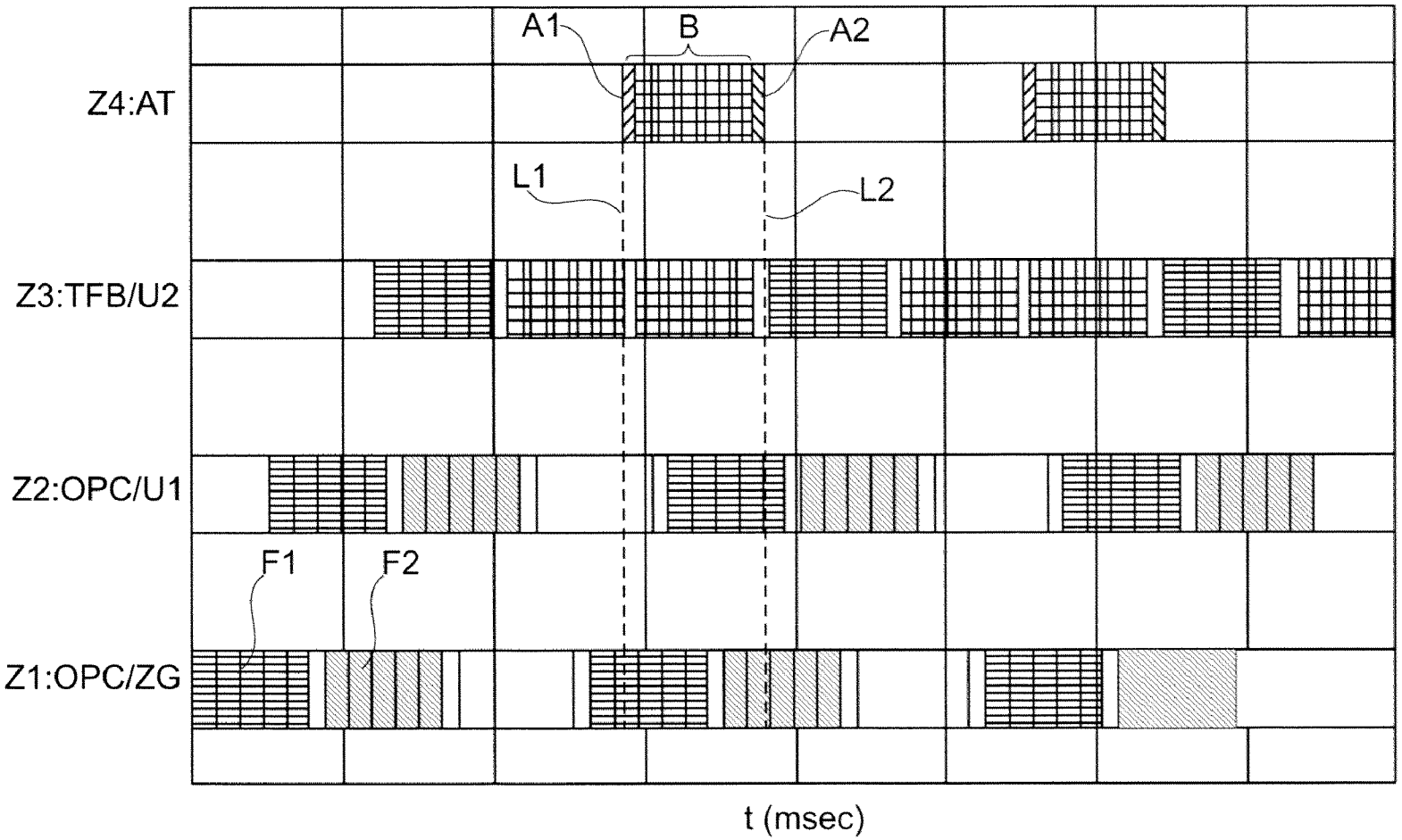
FIG. 4 illustrates the chronological position of the print image with compensation of the disruption via an additional transfer belt revolution, and transfer of the color toner image of the next complete color toner image onto the transfer belt after pivoting the final image carrier onto the transfer belt.

FIG. 4 shows a solution in which, after collecting the colors of a complete color toner image, the transfer belt TFB is moved further by one complete revolution before the final image carrier AT is pivoted onto the transfer belt TFB. With this it is achieved that no disruption is caused at the transfer printing station U1 upon pivoting the transfer belt TFB onto the final image carrier AT.

Figure 5:
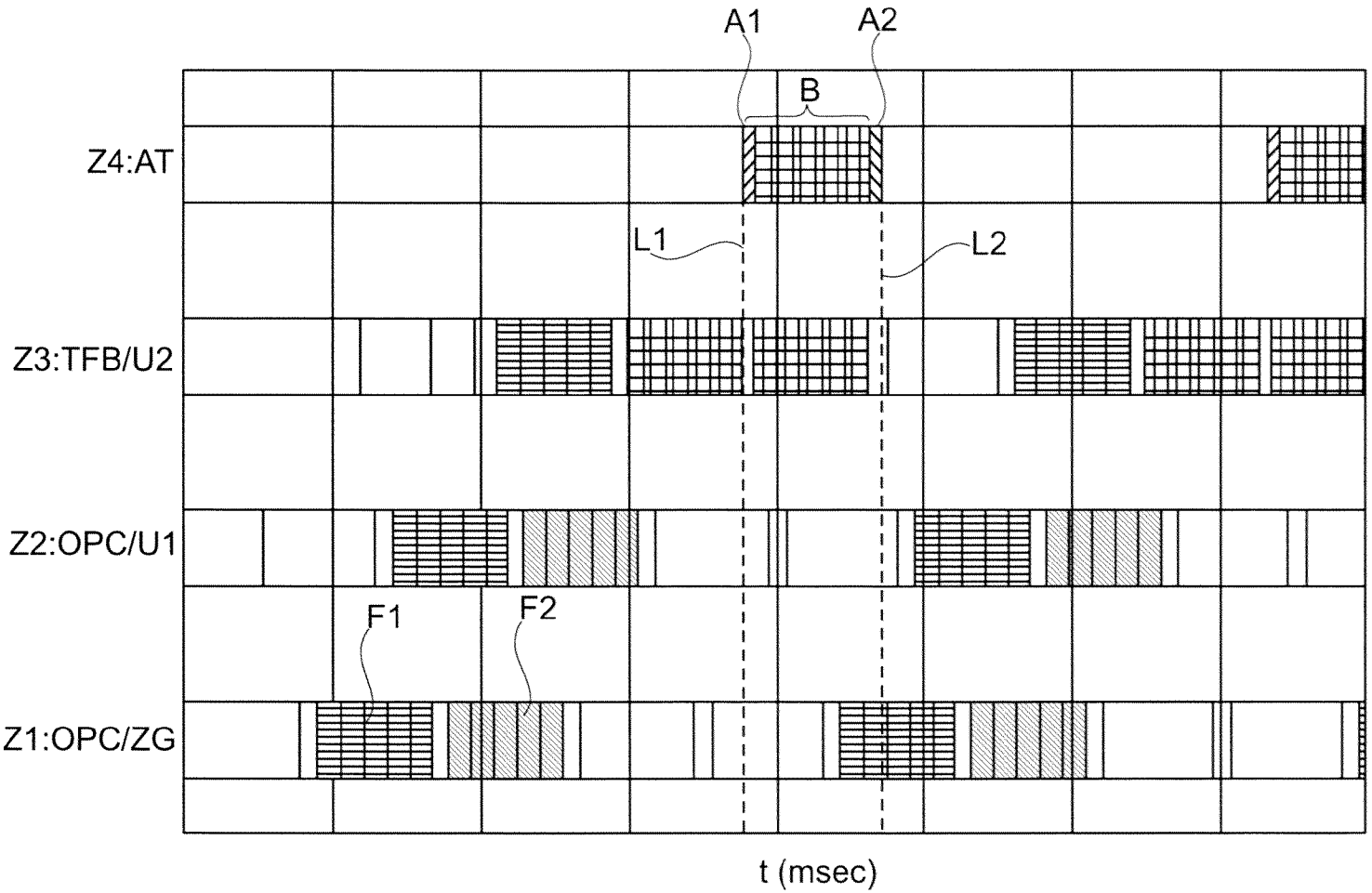
FIG. 5 shows the chronological position of the print image with compensation of the disruption via an additional transfer belt revolution, and transfer of the color toner image of the next complete color toner image onto the transfer belt after pivoting the final image carrier onto or away from the transfer belt.

One solution arises from FIG. 5, in which the transfer belt TFB is moved further by one full revolution after the collection of the colors of a first complete color toner image and the start of the generation of the charge images for the next complete color toner image occurs after pivoting the final image carrier AT forward for transfer printing of the first complete color toner image. Then, upon pivoting the transfer belt TFB both towards and away from the final image carrier AT, no disruptions are caused at the transfer printing station U1 at the point in time of the transfer of color toner images from the photoconductor belt OPC onto the transfer belt TFB. Furthermore, the generation of the charge images on the photoconductor belt OPC is not disrupted by the pivot process.

Figure 6:
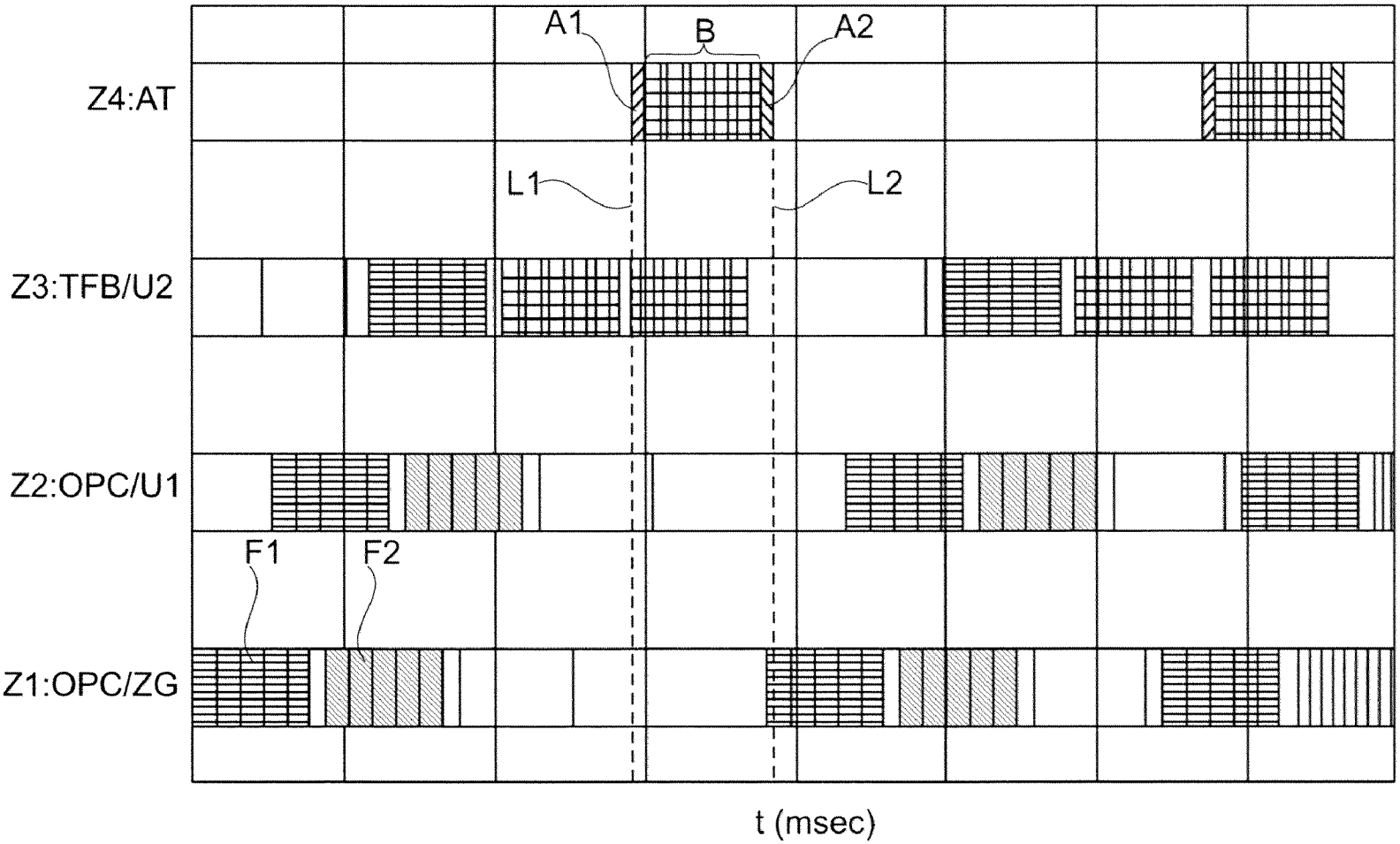
FIG. 6 illustrates the chronological position of the print image with compensation of the disruption via an additional transfer belt revolution via generation of the charge images for the next complete color toner image after pivoting of the final image carrier away, and therefore transfer of the color toner image of the next complete color toner image onto the transfer belt after pivoting the final image carrier onto or away from the transfer belt.

FIG. 6 shows a solution in which the generation of the charge images on the photoconductor belt OPC for the next complete color toner image and the collection of the color toner images on the transfer belt TFB only occur after the pivoting of the final image carrier AT away from the transfer belt TFB after the transfer printing of the preceding complete color toner image B. For this, the collection of the color toner images of the next complete color toner image only occurs in the second revolution of the transfer belt TFB after the transfer printing of the preceding complete color toner image; and, after the collection of the color toner images of the preceding complete color toner image, the transfer belt TFB is moved further by one full revolution before the final image carrier AT is pivoted onto the transfer belt TFB. With this it is achieved that, upon pivoting of the final image carrier AT onto and away from the transfer belt TFB, no disruption is generated at the transfer printing station U1 during the transfer of the color toner images from the photoconductor belt OPC onto the transfer belt TFB, and additionally the generation of the charge images for the next complete color toner image is not disrupted by the retracting pivot movement.

The solutions presented in FIGS. 3 through 6 can be switched between so that the method that best corresponds to the respective application case can be selected.

Although preferred exemplary embodiments have been displayed and described in detail in the drawings and in the preceding specification, these should be viewed as purely exemplary and not as limiting the invention. It is noted that the preferred exemplary embodiments are shown and described, and all variations and modifications that presently and in the future lie within the protective scope of the invention should be protected.

We claim as our invention:

1. A method for electrographic printing of color images on a final image carrier in which charge images of images to be printed are generated on a charge image carrier and are developed into toner images with toner, the toner images being transferred onto an intermediate carrier from which they are transfer-printed at a transfer printing station onto the final image carrier, comprising the steps of:

generating the charge images for individual colors of the color image in succession on the charge image carrier and developing the charge images into individual color toner images with color toner;

transferring the individual color toner images onto the intermediate carrier where they are collected atop one another in a color collection cycle to form a complete color toner image, the intermediate carrier being moved further by one revolution after acceptance of each of the color toner images;

before transfer printing of the complete color toner image on the final image carrier, pivoting the final image carrier onto the intermediate carrier, and after the transfer printing pivoting the final image carrier away from the intermediate carrier; and after transfer printing of the complete color toner image, transferring the color toner images for the next complete color image from the charge image carrier onto the intermediate carrier after an end of the pivoting of the final image carrier away from the intermediate carrier.

2. A method according to claim 1 wherein the generation of the charge images for the next complete color toner image on a photoconductor belt as the charge image carrier occurs only when the final image carrier has been pivoted away from the intermediate carrier after the transfer printing of the preceding complete color toner image.

3. A method according to claim 1 wherein the transfer of the color toner images for the next complete color toner image from the charge image carrier to the intermediate carrier is only implemented when the preceding complete color toner image collected on the intermediate carrier has been moved to the transfer printing station in a second or nth revolution of the intermediate carrier and the transfer printing onto the final image carrier has begun.

4. A method according to claim 3 wherein the generation of the charge images for the next complete color toner image only occurs when the final image carrier has been pivoted onto the intermediate carrier for transfer printing of the preceding complete color toner image.

5. A method according to claim 3 wherein the generation of the charge images for the next complete color toner image occurs only when the final image carrier has been pivoted away from the intermediate carrier after the transfer printing of the preceding complete color toner image.

6. A method for electrographic printing of color images on a final image carrier in which charge images of images to be printed are generated on a charge image carrier and are developed into toner images with toner, the toner images being transferred onto an intermediate carrier from which they are transfer-printed onto the final image carrier, comprising the steps of:

generating the charge images for individual colors of the color image in succession on the charge image carrier and developing the charge images into individual color toner images with color toner;

transferring the individual color toner images onto the intermediate carrier where they are collected atop one another to form a complete color toner image;

before transfer printing of the complete color toner image on the final image carrier, pivoting the final image carrier onto the intermediate carrier, and after the transfer printing pivoting the final image carrier away from the intermediate carrier; and after transfer printing of the complete color toner image, transferring the color toner images for a next complete color image from the charge image carrier onto the intermediate carrier after an end of the pivoting of the final image carrier away from the intermediate carrier.

* * * * *